US011238822B2

(12) United States Patent
Huang

(10) Patent No.: US 11,238,822 B2
(45) Date of Patent: Feb. 1, 2022

(54) DRIVE CIRCUIT AND DRIVE SYSTEM

(71) Applicants: Chongqing HKC Optoelectronics Technology Co., Ltd., Chongqing (CN); HKC Corporation Limited, Shenzhen (CN)

(72) Inventor: Xiaoyu Huang, Chongqing (CN)

(73) Assignees: Chongqing HKC Optoelectronics, Chongqing (CN); Technology Co., Ltd, Shenzhen (CN); HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/043,440

(22) PCT Filed: Oct. 31, 2018

(86) PCT No.: PCT/CN2018/113071
§ 371 (c)(1),
(2) Date: Sep. 29, 2020

(87) PCT Pub. No.: WO2020/042329
PCT Pub. Date: Mar. 5, 2020

(65) Prior Publication Data

US 2021/0027733 A1 Jan. 28, 2021

(30) Foreign Application Priority Data

Aug. 31, 2018 (CN) ..... 201811014947.2

(51) Int. Cl.
*G09G 3/36* (2006.01)

(52) U.S. Cl.
CPC ... *G09G 3/3648* (2013.01); *G09G 2300/0809* (2013.01); *G09G 2330/04* (2013.01)

(58) Field of Classification Search
CPC ..... G09G 3/3648; G09G 2300/0809; G09G 2330/04; G09G 2370/08; G09G 3/20
See application file for complete search history.

(56) References Cited

U.S. PATENT DOCUMENTS 5,285,344 A * 2/1994 Heitzmann ..... H02H 9/041 361/18
5,424,673 A * 6/1995 Edwards ..... G09G 3/36 327/530

(Continued)

FOREIGN PATENT DOCUMENTS

CN 101562443 A 10/2009
CN 201829922 A 5/2011

(Continued)

OTHER PUBLICATIONS

International Search Report dated May 29, 2019, issued in corresponding International Application No. PCT/CN2018/113071, filed Oct. 31, 2018, 2 pages.
Office Action dated Nov. 4, 2019, issued in Chinese Application No. 201811014947.2, filed Aug. 31, 2018, 8 pages.

(Continued)

*Primary Examiner* — Benyam Ketema
(74) *Attorney, Agent, or Firm* — Christensen O'Connor Johnson Kindness PLLC

(57) ABSTRACT

The present disclosure is related to a driver circuit, a preset protection value and a first voltage are input via a first circuit. A first switching circuit is electrically connected to the first circuit and a trigger circuit. A second switching circuit is electrically connected to a first voltage, and the trigger circuit is electrically connected to a printed circuit board.

20 Claims, 3 Drawing Sheets

(56) References Cited

U.S. PATENT DOCUMENTS

| | | | | |
|---|---|---|---|---|
| 8,009,395 | B2 * | 8/2011 | Graves | H02H 3/20 361/56 |
| 2007/0035533 | A1 * | 2/2007 | Kim | G09G 5/006 345/204 |
| 2009/0261894 | A1 * | 10/2009 | Zhou | G09G 3/36 327/537 |
| 2013/0154546 | A1 * | 6/2013 | Kleczewski | H02J 7/2437 320/107 |
| 2013/0249291 | A1 * | 9/2013 | Pan | G06F 1/30 307/31 |
| 2016/0033984 | A1 * | 2/2016 | Lee | G05F 1/575 323/280 |
| 2019/0235326 | A1 * | 8/2019 | Li | G09G 3/3648 |

FOREIGN PATENT DOCUMENTS

| | | | |
|---|---|---|---|
| CN | 102545143 | A | 7/2012 |
| CN | 102565514 | A | 7/2012 |
| CN | 103324265 | A | 9/2013 |
| CN | 104201641 | A | 12/2014 |
| CN | 204333892 | A | 5/2015 |
| CN | 204538649 | A | 8/2015 |
| CN | 105788556 | A | 7/2016 |
| KR | 20060100764 | A | 9/2006 |
| KR | 20120075765 | A | 7/2012 |

OTHER PUBLICATIONS

Office Action dated Jul. 8, 2020, issued in Chinese Application No. 201811014947.2, filed Aug. 31, 2018, 7 pages.

* cited by examiner

DRIVE CIRCUIT AND DRIVE SYSTEM

CROSS-REFERENCE TO RELATED APPLICATIONS

This application claims the benefit of Chinese Patent Application No. 201811014947.2, entitled "driver circuit, driver system and Display", filed on Aug. 31, 2018, the entire content of which is incorporated herein in its entirety.

TECHNICAL FIELD

The present disclosure relates to the field of liquid crystal display technology, and more particularly to a driver circuit and a driver system.

BACKGROUND

TFT-LCD (Thin Film Transistor Liquid Crystal Display) is one of the main varieties of flat panel display, and has become an important display platform in modern IT and video products.

The main driving principle of TFT-LCD is: the system board will connect the R/G/B compression signals (three primary color signals), control signals and power supply through the wire to the connector on PCB (Printed Circuit Board); the data is IC-processed via the TCON (Timing Controller) on the PCB, then the data is connected to a display area through the PCB, the S-COF (Source-Chip on Film), and the G-COF (Gate-Chip on Film); a voltage is transmitted via a Dataline and a Scanline on an array, so as to achieve the display function of the LCD.

The abnormality in front voltage input may cause EOS (Electrical Over Stress), i.e., the input voltage exceeds the withstand voltage of the chip in PCB, resulting in damages to the chip.

SUMMARY

Accordingly, the present disclosure discloses a driver circuit and a driver system to prevent the chip in PCB from damages when the input voltage exceeds the withstand voltage of the chip in PCB.

A driver circuit includes:

a first circuit, a preset protection value is inputted through a first input end of the first circuit, and a first voltage is inputted through a second input end of the first circuit;

a first switching circuit, a first input end of the first switching circuit is electrically connected to an output end of the first circuit, and a second input end of the first switching circuit is electrically connected to an output end of a power source;

a trigger circuit, a first input end of the trigger circuit is electrically connected to an output end of the power source, and a second input end of the trigger circuit is electrically connected to the output end of the first switching circuit;

a second switching circuit, a first input end of the second switching circuit is electrically connected to the first voltage, a second input end of the second switching circuit is electrically connected to an output end of the trigger circuit, and an output end of the second switching circuit is electrically connected to an output end of a printed circuit board;

the first circuit is configured to control the first switching circuit to be turned on and off, in response to detecting that the first circuit is turned on, the trigger circuit controls the second switching circuit to open, and in response to detecting that the first switching circuit is turned off, the trigger circuit controls the second switching circuit to close.

A driver system includes a driver circuit, and the driver circuit includes:

a first circuit, a preset protection value is inputted through a first input end of the first circuit, and a first voltage is inputted through a second input end of the first circuit;

a first switching circuit, a first input end of the first switching circuit is electrically connected to an output end of the first circuit, and a second input end of the first switching circuit is electrically connected to an output end of a power source;

a trigger circuit, a first input end of the trigger circuit is electrically connected to an output end of the power source, and a second input end of the trigger circuit is electrically connected to the output end of the first switching circuit;

a second switching circuit, a first input end of the second switching circuit is electrically connected to the first voltage, a second input end of the second switching circuit is electrically connected to an output end of the trigger circuit, and an output end of the second switching circuit is electrically connected to an output end of a printed circuit board;

the first circuit is configured to control the first switching circuit to be turned on and off, in response to detecting that the first circuit is turned on, the trigger circuit controls the second switching circuit to open, and in response to detecting that the first switching circuit is turned off, the trigger circuit controls the second switching circuit to close.

May be known from the above technical solution, the present disclosure discloses a driver circuit including the first circuit, the first switching circuit, the trigger circuit and the second switching circuit. A preset protection value is inputted through the first input end of the first circuit. A first voltage is inputted through a second input end of the first circuit. A first input end of the first switching circuit is electrically connected to an output end of the first circuit. The second input end of the first switching circuit is electrically connected to the output end of the power source. A first input end of the trigger circuit is electrically connected to the output end of the power source. A second input end of the trigger circuit is electrically connected to the output end of the first switching circuit. A first input end of the second switching circuit is electrically connected to the first voltage. The second input end of the second switch circuit is electrically connected to the output end of the trigger circuit. An output end of the second switching circuit is electrically coupled to an input end of the printed circuit board. The first circuit is used to control the first switching circuit to be turned on and off. The trigger circuit controls the second switch circuit to open when the first switch circuit is turned on. The trigger circuit controls the second switch circuit to close when the first switch circuit is open.

The present disclosure has the cooperation of the first circuit, the first switching circuit, the trigger circuit and the second switching circuit. That is, the first switching circuit is controlled to be turned on by the first circuit, so that the trigger circuit controls the second switching circuit to be open, so that the chip in the printed circuit board can be protected from damage in real time, and the security is greatly improved. Also, the present disclosure also improves the reliability of the product.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

REFERENCE SIGNS

Figure 1:
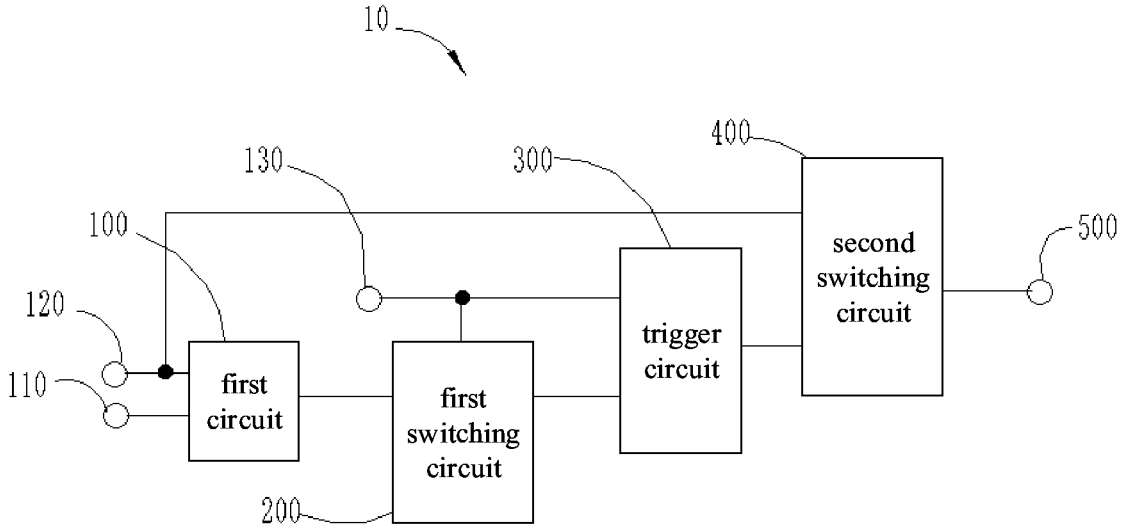
FIG. 1 is a block diagram of a driver circuit according to an embodiment of the present disclosure.

10 driver circuit
100 first circuit
110 preset protection value
120 first voltage
130 power source
140 comparator
150 first current limiting resistor
160 operational amplifier
20 driver system
200 first switching circuit
210 first switching transistor
220 first field effect transistor
300 trigger circuit
310 trigger
320 second current limiting resistor
400 second switching circuit
410 second switching transistor
420 second field effect transistor
500 printed circuit board
600 second current limiting resistor

DETAILED DESCRIPTION OF THE EMBODIMENTS

The technical solutions of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

The embodiments of the present disclosure disclose a driver circuit, a driver system, and a display to prevent the chip in PCB from damages when the input voltage exceeds the withstand voltage of the chip in PCB.

Referring to FIG. 1, a driver circuit 10 according to an embodiment of the present disclosure includes a first circuit 100, a first switching circuit 200, a trigger circuit 300, and a second switching circuit 400. A preset protection value 110 is inputted through the first input end of the first circuit 100. A first voltage 120 is inputted through a second input end of the first circuit 100. A first input end of the first switching circuit 200 is electrically connected to an output end of the first circuit 100. The second input end of the first switching circuit 200 is electrically connected to the output end of the power source 130. A first input end of the trigger circuit 300 is electrically connected to the output end of the power source 130. A second input end of the trigger circuit 300 is electrically connected to the output end of the first switching circuit 200.

A first input end of the second switching circuit 400 is electrically connected to the first voltage 120. The second input end of the second switch circuit 400 is electrically connected to the output end of the trigger circuit 300. An output end of the second switching circuit 400 is electrically coupled to an input end of the printed circuit board 500. The first circuit 100 is used to control the first switching circuit 200 to be turned on and off. The trigger circuit 300 controls the second switch circuit 400 to open when the first switch circuit 200 is turned on. The trigger circuit 300 controls the second switch circuit 200 to close when the first switch circuit 200 is open.

The preset protection value 110 can be set by the first circuit 100. It should be understood that, the specific value of the preset protection value 110 is not limited, as long as it is ensured that the chip in the printed circuit board is prevented from damages. In one of the embodiments, the preset protection value 110 is 14V. In one of the embodiments, the preset protection value 110 is 15V. The first voltage 120 is inputted by the first circuit 100. The first voltage refers to an input voltage on the input end of the printed circuit board. Specifically, the first voltage 120 may be 12V. The output end of the power source outputs a logic high level.

It should be understood that, the specific structure of the first circuit 100 is not specifically limited, as long as the function of controlling the first switching circuit 200 to be turned on and off based on the preset protection value 110 and the first voltage 120 can be achieved. In one of the embodiments, the first circuit 100 can be composed of an operational amplifier and a first resistor electrically connected to the operational amplifier. The preset protection value 110 and the first voltage 120 are input to the operational amplifier, and the operational amplifier controls the first switching circuit 200 to be turned on and off. Meanwhile, the first resistor protects the operational amplifier by current limiting. In other words, the aforementioned functions are achieved by the operational amplifier and the first resistor. In one of the embodiments, the operational amplifier can be replaced by a first comparator, and the aforementioned functions can also be achieved.

A control signal from the first circuit 100 is received by the first switching circuit 200. When the control signal is low level, the first switching circuit 200 is open. When the control signal is high level, the first switching circuit 200 is turned on. In this case, the first switching circuit 200 sends a signal to the second input end of the trigger circuit 300 via the output end. Specific structure of the first switching circuit 200 is not specifically limited, as long as the function of switching according to the control signal from the first circuit 100 is ensured. In one of the embodiments, the first switching circuit 200 is a relay control switch. In one of the embodiments, the first switching circuit 200 is a MOS transistor (field effect transistor) control switch.

The trigger circuit 300 controls the second switching circuit 400 to open and close according to the states of the first switching circuit 200. Specifically, when the first switching circuit 200 is in the turned on state, the trigger circuit 300 controls the second switching circuit 400 to open. When the first switching circuit 200 is in the open, the trigger circuit 300 controls the second switching circuit 400 to close. The specific structure of the trigger circuit 300 is not specifically limited, as long as the function of controlling the second switching circuit 400 to open and close according to the states of the first switching circuit 200 is achieved. In one of the embodiments, the trigger 300 can be composed of a D trigger and a second resistor electrically connected to the D trigger.

When an impulse signal input end of the D trigger receives a rising edge control signal, a Q output end of the D trigger outputs a trigger signal used to trigger the second switching circuit 400 to open. When the impulse signal input end of the D trigger receives a falling edge control signal, the Q output end of the D trigger outputs a trigger signal used to trigger the second switching circuit 400 to close. Meanwhile, the second resistor protects the D trigger by current limiting.

The trigger signal from the trigger circuit 300 is received by the second switching circuit 400. When the trigger signal is rising edge control signal, the second switching circuit 400 is open. When the trigger signal is falling edge control signal, the second switching circuit 400 is turned on. Specific structure of the second switching circuit 400 is not specifically limited, as long as the function of switching according to the trigger signal from the trigger circuit is ensured. In one of the embodiments, the second switching circuit 400 is a relay trigger switch. In one of the embodiments, the second switching circuit 400 is a MOS transistor trigger switch.

The embodiment has the cooperation of the first circuit 100, the first switching circuit 200, the trigger circuit 300 and the second switching circuit 400. That is, the first switching circuit 200 is controlled to be turned on by the first circuit 100, so that the trigger circuit 300 controls the second switching circuit 400 to be open, so that the chip in the printed circuit board can be protected from damage in real time, and the security is greatly improved. Also, the reliability of the product is improved.

Figure 2:
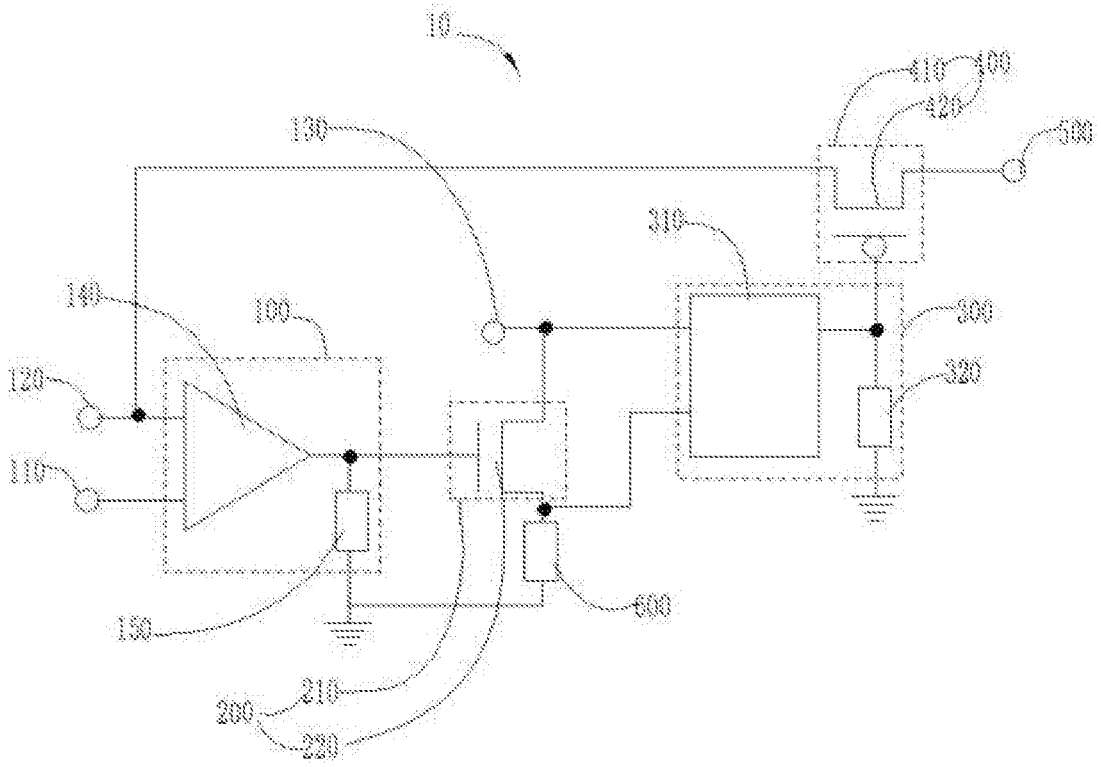
FIG. 2 is a circuit diagram of a driver circuit according to an embodiment of the present disclosure.

Referring to FIG. 2, in one of the embodiments, the first circuit 100 includes a comparator 140. The preset protection value 110 is inputted through a first input end of the comparator 140. The first voltage 120 is inputted through a second input end of the comparator 140. An output end of the comparator 140 is electrically connected to the first input end of the first switching circuit 200. When the comparator 140 outputs a high level, the first switching circuit 200 is turned on. When the comparator 140 outputs a low level, the first switching circuit 200 is turned on.

It should be understood that, the first circuit 100 includes but is not limited to the comparator 140. In one of the embodiments, the comparator 140 can be replaced by a first operational amplifier. Specifically, the preset protection value 110 and the first voltage 120 are input to the comparator 140, when the preset protection value 110 is less than or equal to the value of the first voltage 120, the first switching circuit 200 is open. When the preset protection value 110 is greater than the value of the first voltage 120, the first switching circuit 200 is turned on.

In one of the embodiments, the first circuit 100 further includes a first current limiting resistor 150. One end of the first current limiting resistor 150 is electrically connected to the output end of the comparator 140. The other end of the first current limiting resistor 150 is grounded. It should be understood that, the specific structure of the first current limiting resistor 150 is not specifically limited, as long as the function of current limiting is achieved. In one of the embodiments, the first current limiting resistor 150 is a slide rheostat with variable resistance. In one of the embodiments, the first current limiting resistor 150 is a resistor with fixed resistance.

In one of the embodiments, the first circuit 100 includes an operational amplifier 160. The preset protection value 110 is inputted through a first input end of the operational amplifier 160. The first voltage 120 is inputted through a second input end of the operational amplifier 160. An output end of the operational amplifier 160 is electrically connected to the first input end of the first switching circuit 200. When the operational amplifier 160 outputs a high level, the first switching circuit 200 is turned on. When the operational amplifier 160 outputs a low level, the first switching circuit 200 is open.

In one of the embodiments, the preset protection value 110 and the first voltage 120 are input to operational amplifier 160, when the operational amplifier 160 outputs a low level, the first switching circuit 200 is open. When the operational amplifier 160 outputs a high level, the first switching circuit 200 is turned on.

In one of the embodiments, the first switching circuit 200 includes a first switching transistor 210. A first input end of the first switching transistor 210 is electrically connected to the output end of the first circuit 100. A second input end of the first switching transistor 210 is electrically connected to the output end of the power source 130. An output end of the first switching transistor 210 is electrically connected to the second input end of the trigger circuit 300.

It should be understood that, the specific structure of the first switching transistor 210 is not specifically limited, as long as the function of switching according to the control signal from the first circuit 100 is ensured. In one of the embodiments, the first switching transistor 210 is a relay control switch. In one of the embodiments, the first switching transistor 210 is a MOS transistor control switch.

In one of the embodiments, the first switching transistor 210 includes a first field effect transistor 220. A gate of the first field effect transistor 220 is electrically connected to the output end of the first circuit 100. A drain of the first field effect transistor 220 is electrically connected to the output end of the power source 130, and a source of the first field effect transistor 220 is electrically connected to the second input end of the trigger circuit 300. Alternatively, the source of the first field effect transistor 220 is electrically connected to the output end of the power source 130, and the drain of the first field effect transistor 220 is electrically connected to the second input end of the trigger circuit 300.

It should be understood that, when the drain of the first field effect transistor 220 is electrically connected to the output end of the power source 130, the source of the first field effect transistor 220 is electrically connected to the second input end of the trigger circuit 300. When the source of the first field effect transistor 220 is electrically connected to the output end of the power source 130, and the drain of the first field effect transistor 220 is electrically connected to the second input end of the trigger circuit 300. I.e., the drain and the source of the first field effect transistor 220 can be selected according to actual demands, the location relationship therebetween is not specifically limited. The first field effect transistor 220 can be a N-channel trench MOS transistor. The first field effect transistor 220 can also be a P-channel trench MOS transistor. The specific structure of the first field effect transistor 220 can be selected according to actual demands.

In one of the embodiments, the trigger circuit 300 includes a trigger 310. A D input end of the trigger 310 is electrically connected to the output end of the power source 130. An impulse input end of the trigger 310 is electrically connected to the output end of the first switching circuit 200. A Q output end of the trigger 310 is electrically connected to the second input end of the second switching circuit 400. The trigger 310 can be a rising edge D trigger. Specifically, when the impulse input end of the trigger 310 receives a rising edge control signal, the Q output end of the D trigger outputs a trigger signal that triggers the second switching circuit 400 to open. When the impulse input end of the trigger 310 receives a falling edge control signal, the Q output end of the D trigger outputs no signal (i.e., the operation state of the second switching circuit 400 is not changed).

In one of the embodiments, the trigger circuit 300 further includes a second current limiting resistor 320. One end of the second current limiting resistor 320 is electrically connected to the Q output end of the trigger 310 and the second input end of the second switching circuit 400, respectively. The other end of the second current limiting resistor 320 is grounded. It should be understood that, the specific structure of the second current limiting resistor 320 is not specifically limited, as long as the function of current limiting is achieved. In one of the embodiments, the second current limiting resistor 320 is a slide rheostat with variable resistance. In one of the embodiments, the second current limiting resistor 320 is a resistor with fixed resistance.

In one of the embodiments, the second switching circuit 400 includes a second switching transistor 410. A second input end of the second switching transistor 410 is electrically connected to the output end of the trigger circuit 300. A first input end of the second switching transistor 410 is electrically connected to the first voltage 120. An output end of the second switching transistor 410 is electrically connected to a input end of the printed circuit board 500.

It should be understood that, the specific structure of the second switching transistor 410 is not specifically limited, as long as the function of switching according to the control signal from the trigger circuit 300 is ensured. In one of the embodiments, the second switching transistor 410 is a relay control switch. In one of the embodiments, the second switching transistor 410 is a MOS transistor control switch.

In one of the embodiments, the second switching transistor 410 includes a second field effect transistor 420. A gate of the second field effect transistor 420 is electrically connected to the output end of the trigger circuit 300. A source of the second field effect transistor 420 is electrically connected to the first voltage 120, and a drain of the second field effect transistor 420 is electrically connected to the second input end of the printed circuit board 500. Alternatively, the drain of the second field effect transistor 420 is electrically connected to the first voltage 120, and the source of the first second effect transistor 420 is electrically connected to the second input end of the printed circuit board 500.

It should be understood that, when the source of the second field effect transistor 420 is electrically connected to the first voltage 120, the drain of the second field effect transistor 420 is electrically connected to the printed circuit board 500. When the drain of the second field effect transistor 420 is electrically connected to the first voltage 120, the source of the second field effect transistor 420 is electrically connected to the printed circuit board 500. I.e., the drain and the source of the second field effect transistor 420 can be selected according to actual demands, the location relationship therebetween is not specifically limited. The second field effect transistor 420 can be an N-channel trench MOS transistor. The second field effect transistor 420 can also be a P-channel trench MOS transistor. The specific configuration can be selected according to actual demands. In one of the embodiments, the second field effect transistor 420 is a P-channel trench MOS transistor, and the first field effect transistor 220 is an N-channel trench MOS transistor. In one of the embodiments, the second field effect transistor 420 is an N-channel trench MOS transistor, and the first field effect transistor 220 is a P-channel trench MOS transistor.

In one of the embodiments, the drive circuit 10 further includes a third current limiting resistor 600. One end of the third current limiting resistor 600 is electrically connected to the output end of the first switching circuit 200 and the second input end of the trigger circuit 300, respectively. The other end of the third current limiting resistor 600 is grounded. It should be understood that, the specific structure of the third current limiting resistor 600 is not specifically limited, as long as the function of current limiting is achieved. In one of the embodiments, the third current limiting resistor 600 is a slide rheostat with variable resistance. In one of the embodiments, the third current limiting resistor 600 is a resistor with fixed resistance.

Figure 3:
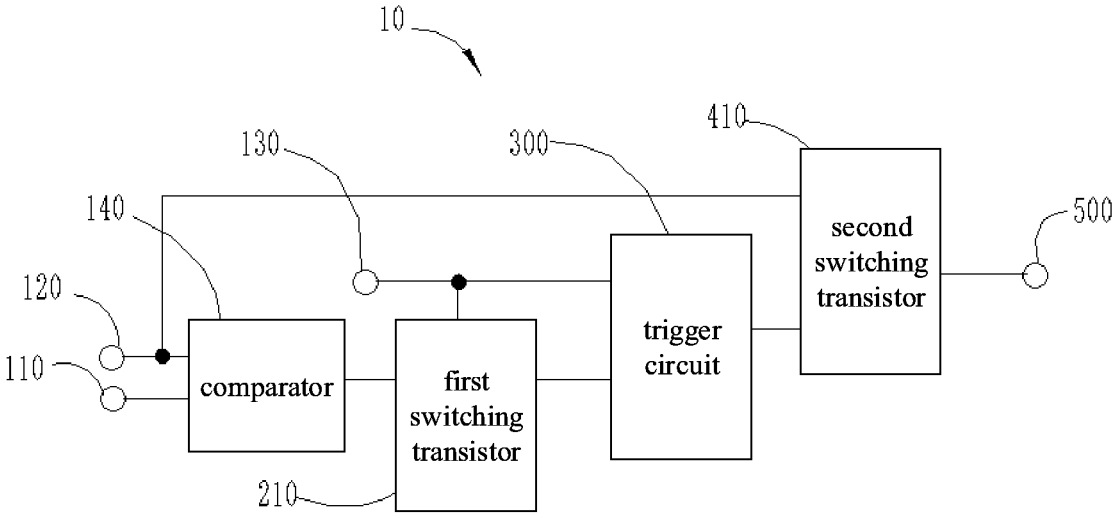
FIG. 3 is a block diagram of a driver circuit according to another embodiment of the present disclosure.

Referring to FIG. 3, a driver circuit 10 according to an embodiment of the present disclosure includes the comparator 140, the first switching transistor 210, the trigger circuit 300, and the second switching transistor 410. The preset protection value 110 is inputted through the first input end of the comparator 140. The first voltage 120 is inputted through a second input end of the comparator 140. The first input end of the first switching transistor 210 is electrically connected to the output end of the comparator 140. The second input end of the first switching transistor 210 is electrically connected to the output end of the power source 130. The first input end of the trigger circuit 300 is electrically connected to the output end of the power source 130. The second input end of the trigger circuit 300 is electrically connected to the output end of the first switching transistor 210.

The first input end of the second switching transistor 410 is electrically connected to the first voltage 120. The second input end of the second switch circuit 410 is electrically connected to the output end of the trigger circuit 300. The output end of the second switching transistor 410 is electrically coupled to an input end of the printed circuit board 500. The comparator 140 is used to control the first switching transistor 210 to be turned on and off. The trigger circuit 300 controls the second switch transistor 410 to open when the first switch transistor 210 is turned on. The trigger circuit 300 controls the second switch transistor 410 to close when the first switch transistor 210 is open.

The preset protection value 110 can be set by the comparator 140. It should be understood that, the specific value of the preset protection value 110 is not limited, as long as it is ensured that the chip in the printed circuit board is prevented from damages. In one of the embodiments, the preset protection value 110 is 14V. In one of the embodiments, the preset protection value 110 is 15V. The first voltage 120 is inputted by the comparator 140. The first voltage refers to an input voltage on the input end of the printed circuit board. Specifically, the first voltage 120 may be 12V. The output end of the power source outputs a logic high level. In one of the embodiments, the operational amplifier can be replaced with a second comparator, and the aforementioned functions can also be achieved.

A control signal from the comparator 140 is received by the first switching circuit 210. When the control signal is low level, the first switching transistor 210 is open. When the control signal is high level, the first switching transistor 210 is turned on. In this case, the first switching transistor 210 sends a signal to the second input end of the trigger circuit 300 via the output end. Specific structure of the first switching transistor 210 is not specifically limited, as long as the function of switching according to the control signal from the comparator 140 is ensured. In one of the embodiments, the first switching transistor 210 is a relay control switch. In one of the embodiments, the first switching transistor 210 is a MOS transistor control switch.

The trigger circuit 300 controls the second switching transistor 410 to open and close according to the states of the first switching transistor 210. Specifically, when the first switching transistor 210 is in the turned on state, the trigger circuit 300 controls the second switching transistor 410 to open. When the first switching transistor 210 is in the open, the trigger circuit 300 controls the second switching transistor 410 to close. The specific structure of the trigger circuit 300 is not specifically limited, as long as the function of controlling the second switching transistor 410 to open and close according to the states of the first switching transistor 210 is achieved. In one of the embodiments, the trigger 300 can be composed of a D trigger and a second resistor electrically connected to the D trigger.

When an impulse signal input end of the D trigger receives a rising edge control signal, a Q output end of the D trigger outputs a trigger signal used to trigger the second switching transistor 410 to open. When the impulse signal input end of the D trigger receives a falling edge control signal, the Q output end of the D trigger outputs a trigger signal used to trigger the second switching transistor 410 to close. Meanwhile, the second resistor protects the D trigger by current limiting.

The trigger signal from the trigger circuit 300 is received by the second switching transistor 410. When the trigger signal is rising edge control signal, the second switching transistor 410 is open. When the trigger signal is falling edge control signal, the second switching transistor 410 is turned on. Specific structure of the second switching transistor 410 is not specifically limited, as long as the function of switching according to the trigger signal from the trigger circuit is ensured. In one of the embodiments, the second switching transistor 410 is a relay trigger switch. In one of the embodiments, the second switching transistor 410 is a MOS transistor trigger switch.

The embodiment has the cooperation of the comparator 140, the first switching transistor 210, the trigger circuit 300 and the second switching transistor 410. That is, the first switching transistor 210 is controlled to be turned on by the comparator 140, so that the trigger circuit 300 controls the second switching transistor 410 to be open, so that the chip in the printed circuit board can be protected from damage in real time, and the security is greatly improved. Also, the reliability of the product is improved.

Figure 4:
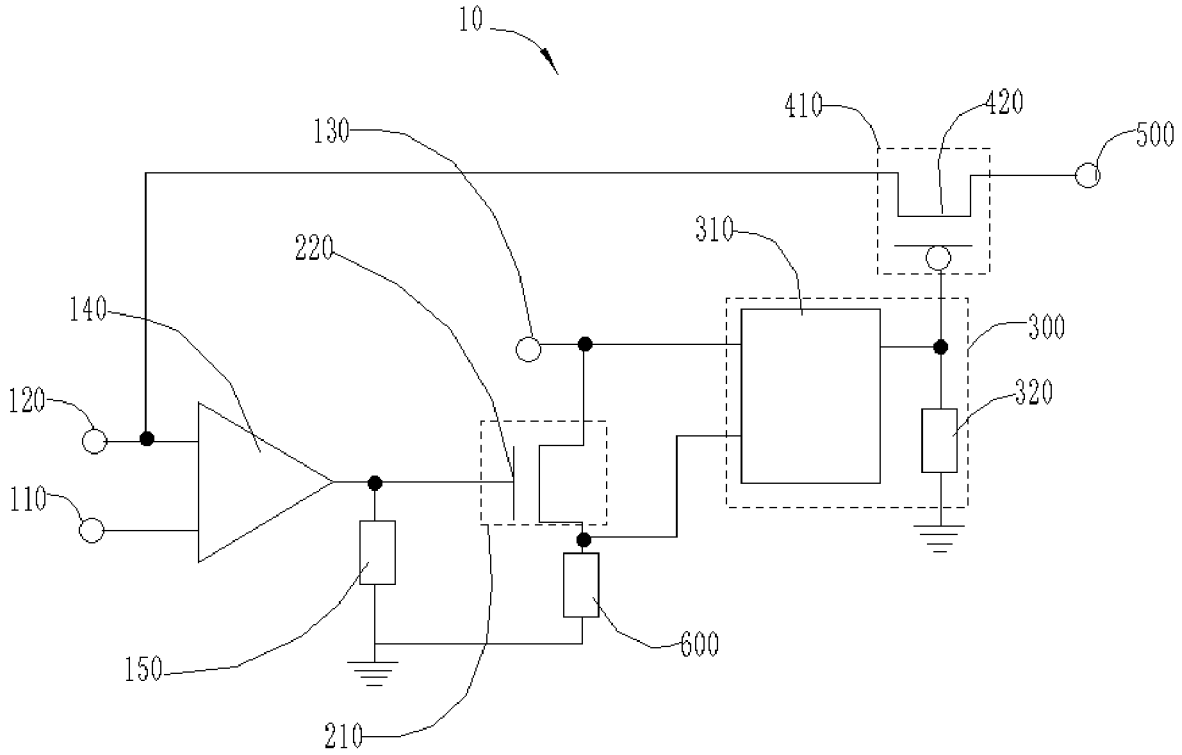
FIG. 4 is a circuit diagram of a driver circuit according to another embodiment of the present disclosure.

Referring to FIG. 4, in one of the embodiments, the trigger circuit 300 includes a trigger 310 and a second current limiting resistor 320. A D input end of the trigger 310 is electrically connected to the output end of the power source 130. An impulse input end of the trigger 310 is electrically connected to the output end of the first switching transistor 210. A Q output end of the trigger 310 is electrically connected to the second input end of the second switching transistor 410. One end of the second current limiting resistor 320 is electrically connected to the Q output end of the trigger 310 and the second input end of the second switching transistor 410, respectively. The other end of the second current limiting resistor is grounded.

In one of the embodiments, the trigger 310 can be a rising edge D trigger. Specifically, when the impulse input end of the trigger 310 receives a rising edge control signal, the Q output end of the D trigger outputs a trigger signal that triggers the second switching transistor 400 to open. When the impulse input end of the trigger 310 receives a falling edge control signal, the Q output end of the D trigger outputs no signal (i.e., the operation state of the second switching transistor 400 is not changed).

It should be understood that, the specific structure of the second current limiting resistor 320 is not specifically limited, as long as the function of current limiting is achieved. In one of the embodiments, the second current limiting resistor 320 is a slide rheostat with variable resistance. In one of the embodiments, the second current limiting resistor 320 is a resistor with fixed resistance.

The working process of the present disclosure is as follows:

The second switching circuit 400 is a P-channel trench MOS transistor. When the control signal received from the gate of the P-channel trench MOS transistor is low level, the P-channel trench MOS transistor is turned on. When the control signal received from the gate of the P-channel trench MOS transistor is high level, the P-channel trench MOS transistor is turned off. The first switching circuit 200 is a N-channel trench MOS transistor. When the gate control signal of the N-channel trench MOS transistor is high level, the N-channel trench MOS transistor is turned on. When the gate control signal of the N-channel trench MOS transistor is low level, the N-channel trench MOS transistor is turned off The trigger circuit 300 is composed of a rising edge D trigger and a second resistor. When an impulse end of the rising edge D trigger receives a rising edge signal, the logic level of the D input end of the rising edge D trigger is assigned to the Q output end.

The first circuit is composed of a first comparator and a third resistor. When a voltage at a positive input end of the first comparator (i.e., the first voltage 120) is less than or equal to that at a negative input end (i.e., the preset protection value 110), the first comparator outputs a logic low level. When the voltage at the positive input end of the first comparator (i.e., the first voltage 120) is greater than that at a negative input end (i.e., the preset protection value 110), the first comparator outputs a logic high level.

In a normal operation, the positive input of the first comparator is a constant DC voltage (typically 12V). When the voltage at the positive input end of the first comparator is less than or equal to the voltage at the negative input end, the first comparator outputs the logic low level. The N-channel trench MOS transistor is turned off. Since the third resistor is grounded, the impulse input end of the rising edge D trigger has a low level at this time. The trigger signal received from the gate of the P-channel trench MOS transistor is turning on, at this time, the P-channel trench MOS transistor is turned on, that is, the P-channel trench MOS transistor normally operates.

When the positive input end of the first comparator is abnormal and causes that the voltage at the positive input end exceeds the voltage at the negative input end, the first comparator outputs the logic high level. The N-channel trench MOS transistor is turned on. At this time, the low level of the impulse input end of the rising edge D trigger is converted into a high level (i.e., rising edge), that is, the rising edge D trigger inputs a turn-off trigger signal to the gate of the P-channel trench MOS transistor. The P-channel trench MOS transistor is turned off. At this time, the input end of the printed circuit board 500 is disconnected to the first voltage 120, the problem that the internal chip of the printed circuit board 500 is burnt due to the abnormality of the input terminal is avoided.

In summary, the present disclosure has the cooperation of the first circuit 100, the first switching circuit 200, the trigger circuit 300 and the second switching circuit 400. That is, the first switching circuit 200 is controlled to be turned on by the first circuit 100, so that the trigger circuit 300 controls the second switching circuit 400 to be open, so that the chip in the printed circuit board can be protected from damage in real time, and the security is greatly improved. Also, the reliability of the product is improved.

Figure 5:
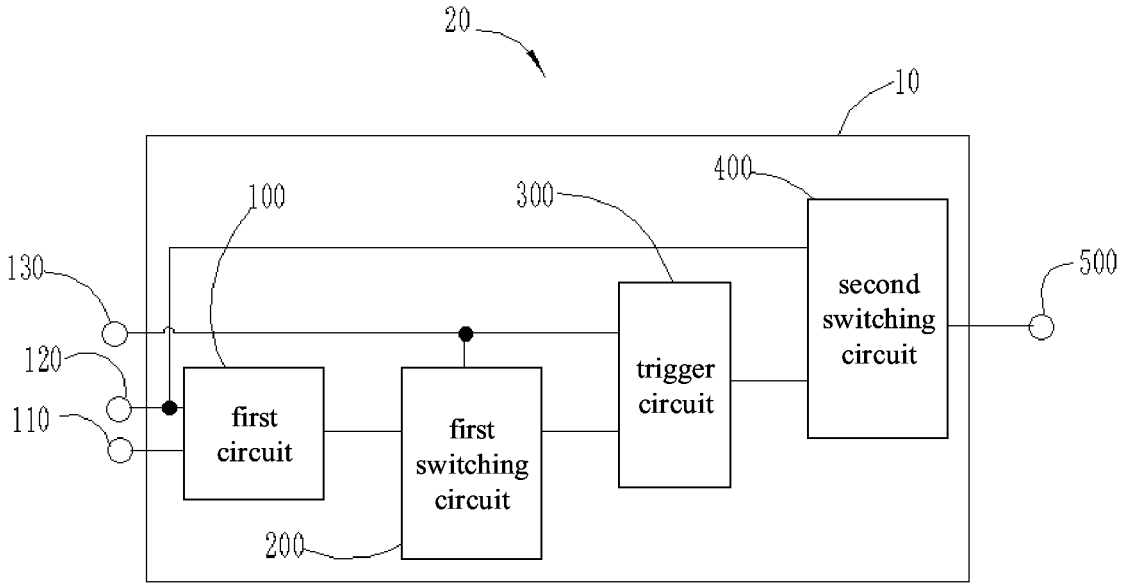
FIG. 5 is a block diagram of a driver system according to an embodiment of the present disclosure.

Referring to FIG. 5, an embodiment of the present disclosure provides a driver system 20, which includes a driver circuit 10 from any one of the aforementioned embodiments.

Finally, it should be noted that, as used herein, the terms "first", "second", and the like in the description and the claims, if any, may be used for distinguishing between similar elements or operations and not necessarily for describing a particular sequential or chronological order. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. An element that is defined by the phrase "comprising a . . . " does not exclude the presence of additional equivalent elements in the process, method, item, or device that comprises the element if no additional limitation is introduced.

The various embodiments in this specification are described in a progressive manner, and each embodiment focuses on differences from other embodiments, and the same similar parts between the various embodiments can be referred to each other.

Although the present disclosure is illustrated and described herein with reference to specific embodiments, the invention is not intended to be limited to the details shown. Rather, various modifications may be made in the details within the scope and range of equivalents of the claims and without departing from the invention.

What is claimed is:

1. A driver circuit, comprising:

a first circuit, wherein a preset protection value is inputted through a first input end of the first circuit, and a first voltage is inputted through a second input end of the first circuit;

a first switching circuit, wherein a first input end of the first switching circuit is electrically connected to an output end of the first circuit, and a second input end of the first switching circuit is electrically connected to an output end of a power source;

a trigger circuit, wherein a first input end of the trigger circuit is electrically connected to an output end of the power source, and a second input end of the trigger circuit is electrically connected to the output end of the first switching circuit;

a second switching circuit, wherein a first input end of the second switching circuit is electrically connected to the first voltage, a second input end of the second switching circuit is electrically connected to an output end of the trigger circuit, and an output end of the second switching circuit is electrically connected to an output end of a printed circuit board;

wherein the first circuit is configured to control the first switching circuit to be turned on and off, in response to detecting that the first circuit is turned on, the trigger circuit controls the second switching circuit to be turned off, and in response to detecting that the first switching circuit is turned off, the trigger circuit controls the second switching circuit to be turned on.

2. The driver circuit according to claim 1, wherein the first circuit comprises:

a comparator, wherein the preset protection value is inputted through a first input end of the comparator, and the first voltage is inputted through a second input end of the comparator, and an output end of the comparator is electrically connected to the first input end of the first switching circuit;

in response to detecting that a high level is outputted via the comparator, the first switching circuit is turned on, and in response to detecting that a low level is outputted via the comparator, the first switching circuit is open.

3. The driver circuit according to claim 2, wherein the first circuit further comprises:

a first current limiting resistor, wherein one end of the first current limiting resistor is electrically connected to the output end of the comparator, and the other end of the first current limiting resistor is grounded.

4. The driver circuit according to claim 1, wherein the first circuit comprises:

an operational amplifier, wherein a preset protection value is inputted through a first input end of the operational amplifier, and a first voltage is inputted through a second input end of the operational amplifier, and an output end of the operational amplifier is electrically connected to the first input end of the first switching circuit;

in response to detecting that a high level is outputted via the operational amplifier, the first switching circuit is turned on, and in response to detecting that a low level is outputted via the operational amplifier, the first switching circuit is open.

5. The driver circuit according to claim 1, wherein the first circuit comprises:

a first switching transistor, wherein a first input end of the first switching transistor is electrically connected to the output end of the first circuit, a second input end of the first switching transistor is electrically connected to the output end of the power source, and an output end of the first switching transistor is electrically connected to the second input end of the trigger circuit.

6. The driver circuit according to claim 5, wherein the first switching transistor comprises:

a first field effect transistor, wherein a gate of the first field effect transistor is electrically connected to the output end of the first circuit, a drain of the first field effect transistor is electrically connected to the output end of the power source, and a source of the first field effect transistor is electrically connected to the second input end of the trigger circuit.

7. The driver circuit according to claim 5, wherein the first switching transistor comprises:

a first field effect transistor, wherein a gate of the first field effect transistor is electrically connected to the output end of the first circuit, a source of the first field effect transistor is electrically connected to the output end of the power source, and a drain of the first field effect transistor is electrically connected to the second input end of the trigger circuit.

8. The driver circuit according to claim 1, wherein the trigger circuit comprises:

a trigger, wherein a D input end of the trigger is electrically connected to the output end of the power source, an impulse input end of the trigger is electrically connected to the output end of the first switching circuit, and a Q output end of the trigger is electrically connected to the second input end of the second switching circuit.

9. The driver circuit according to claim 8, wherein the trigger circuit further comprises:

a second current limiting resistor, wherein one end of the second current limiting resistor is electrically connected to the Q output end of the trigger and the second input end of the second switching circuit, respectively, and the other end of the second current limiting resistor is grounded.

10. The driver circuit according to claim 1, wherein the second switching circuit comprises:

a second switching transistor, wherein a second input end of the second switching transistor is electrically connected to the output end of the trigger circuit, a first input end of the second switching transistor is electrically connected to the first voltage, and an output end of the second switching transistor is electrically connected to the input end of the printed circuit board.

11. The driver circuit according to claim 10, wherein the second switching transistor comprises:

a second field effect transistor, wherein a gate of the second field effect transistor is electrically connected to the output end of the trigger circuit, a source of the second field effect transistor is electrically connected to the first voltage, and a drain of the second field effect transistor is electrically connected to the input end of the printed circuit board.

12. The driver circuit according to claim 10, wherein the second switching transistor comprises:

a second field effect transistor, wherein a gate of the second field effect transistor is electrically connected to the output end of the trigger circuit, a drain of the second field effect transistor is electrically connected to the first voltage, and a source of the second field effect transistor is electrically connected to the input end of the printed circuit board.

13. The driver circuit according to claim 1, further comprising:

a third current limiting resistor, wherein one end of the third current limiting resistor is electrically connected to the output end of the first switching circuit and the second input end of the trigger circuit, respectively, and the other end of the third current limiting resistor is grounded.

14. A driver circuit, comprising:

a comparator, wherein a preset protection value is inputted through a first input end of the comparator, and a first voltage is inputted through a second input end of the comparator;

a first switching transistor, wherein a first input end of the first switching transistor is electrically connected to an output end of comparator, and a second input end of the first switching transistor is electrically connected to an output end of a power source;

a trigger circuit, wherein a first input end of the trigger circuit is electrically connected to an output end of the power source, and a second input end of the trigger circuit is electrically connected to the output end of the first switching transistor;

a second switching transistor, wherein a first input end of the second switching transistor is electrically connected to the first voltage, a second input end of the second switching transistor is electrically connected to an output end of the trigger circuit, and an output end of the second switching transistor is electrically connected to an input a printed circuit board;

wherein the comparator is configured to control the first switching transistor to be turned on and off, in response to detecting that the first transistor is turned on, the trigger circuit controls the second switching transistor to open, and in response to detecting that the first switching transistor is turned off, the trigger circuit controls the second switching transistor to close.

15. The driver circuit according to claim 14, wherein the first switching transistor comprises:

a first field effect transistor, wherein a gate of the first field effect transistor is electrically connected to the output end of the comparator, a drain of the first field effect transistor is electrically connected to the output end of the power source, and a source of the first field effect transistor is electrically connected to the second input end of the trigger circuit.

16. The driver circuit according to claim 14, wherein the first switching transistor comprises:

a first field effect transistor, wherein a gate of the first field effect transistor is electrically connected to the output end of the comparator, a source of the first field effect transistor is electrically connected to the output end of the power source, and a drain of the first field effect transistor is electrically connected to the second input end of the trigger circuit.

17. The driver circuit according to claim 14, wherein the trigger circuit comprises:

a trigger, wherein a D input end of the trigger is electrically connected to the output end of the power source, an impulse input end of the trigger is electrically connected to the output end of the first switching transistor, and a Q output end of the trigger is electrically connected to the second input end of the second switching transistor;

a second current limiting resistor, wherein one end of the second current limiting resistor is electrically connected to the Q output end of the trigger and the second input end of the second switching transistor, respectively, and the other end of the second current limiting resistor is grounded.

18. The driver circuit according to claim 14, wherein the second switching transistor comprises:

a second field effect transistor, wherein a gate of the second field effect transistor is electrically connected to the output end of the trigger circuit, a source of the second field effect transistor is electrically connected to the first voltage, and a drain of the second field effect transistor is electrically connected to the input end of the printed circuit board.

19. The driver circuit according to claim 14, wherein the second switching transistor comprises:

a second field effect transistor, wherein a gate of the second field effect transistor is electrically connected to the output end of the trigger circuit, a drain of the second field effect transistor is electrically connected to the first voltage, and a source of the second field effect transistor is electrically connected to the input end of the printed circuit board.

20. A driver system, comprising a driver circuit, wherein the driver circuit comprises:

a first circuit, wherein a preset protection value is inputted through a first input end of the first circuit, and a first voltage is inputted through a second input end of the first circuit;

a first switching circuit, wherein a first input end of the first switching circuit is electrically connected to an output end of the first circuit, and a second input end of the first switching circuit is electrically connected to an output end of a power source;

a trigger circuit, wherein a first input end of the trigger circuit is electrically connected to an output end of the power source, and a second input end of the trigger circuit is electrically connected to the output end of the first switching circuit;

a second switching circuit, wherein a first input end of the second switching circuit is electrically connected to the first voltage, a second input end of the second switching circuit is electrically connected to an output end of the trigger circuit, and an output end of the second switching circuit is electrically connected to an output end of a printed circuit board;

wherein the first circuit is configured to control the first switching circuit to be turned on and off, in response to detecting that the first circuit is turned on, the trigger circuit controls the second switching circuit to open, and in response to detecting that the first switching circuit is turned off, the trigger circuit controls the second switching circuit to close.

* * * * *